United States Patent [19]

Hognestad et al.

[11] Patent Number: 5,018,940

[45] Date of Patent: May 28, 1991

[54] APPARATUS FOR SEPARATING A NUMBER OF PERIODICALS FROM A STACK OF PERIODICALS

[75] Inventors: Jon Hognestad; Einar K. Selvig, both of Kongsberg, Norway

[73] Assignee: Media Craft a.s., Kongsberg, Norway

[21] Appl. No.: 467,183

[22] Filed: Jan. 19, 1990

[30] Foreign Application Priority Data

Jan. 20, 1989 [NO] Norway ..... 890268

[51] Int. Cl.[5] ..... B65G 59/02

[52] U.S. Cl. ..... 414/796.8; 221/241; 271/130

[58] Field of Search ..... 221/241, 268, 270; 271/130, 138; 414/796.7, 796.8, 796.9, 797, 797.1

[56] References Cited

U.S. PATENT DOCUMENTS

| | | | |
|---|---|---|---|
| 2,665,633 | 1/1954 | Schubert | 414/796.8 X |
| 3,174,633 | 3/1965 | Stevens | 414/796.8 X |
| 3,357,700 | 12/1967 | Bradicich | 271/130 |

FOREIGN PATENT DOCUMENTS

| | | | |
|---|---|---|---|
| 3506893 | 8/1986 | Fed. Rep. of Germany | 414/796.8 |

*Primary Examiner*—Robert J. Spar
*Assistant Examiner*—Janice Krizek
*Attorney, Agent, or Firm*—Dressler, Goldsmith, Shore, Sutker & Milnamow, Ltd.

[57] ABSTRACT

An apparatus for separating one or more essentially thin and planar products (3), such as books, periodicals and newspapers, from a stack (2) of such products. The apparatus includes a gripping arrangement (6) for gripping of at least one product (3) at a time at the top of the stack (2), and for lateral movement of the product to engagement with a further-feeding transport apparatus (7), and a threshold construction (14) forming an abutment against the products (3) below the product to be separated at a time, and which has a slot opening (15) having a height (H) allowing the passing of only said at least one product at a time. The threshold construction (14) is connected to a position sensor (20) sensing the top level of the stack (2) and giving a signal to a regulator (5) and the regulator controls a stack-supporting hoisting mechanism (1), so that the hoisting mechanism raises the stack (2) to the correct top level in relation to the threshold construction.

7 Claims, 2 Drawing Sheets

APPARATUS FOR SEPARATING A NUMBER OF PERIODICALS FROM A STACK OF PERIODICALS

Figure 1:
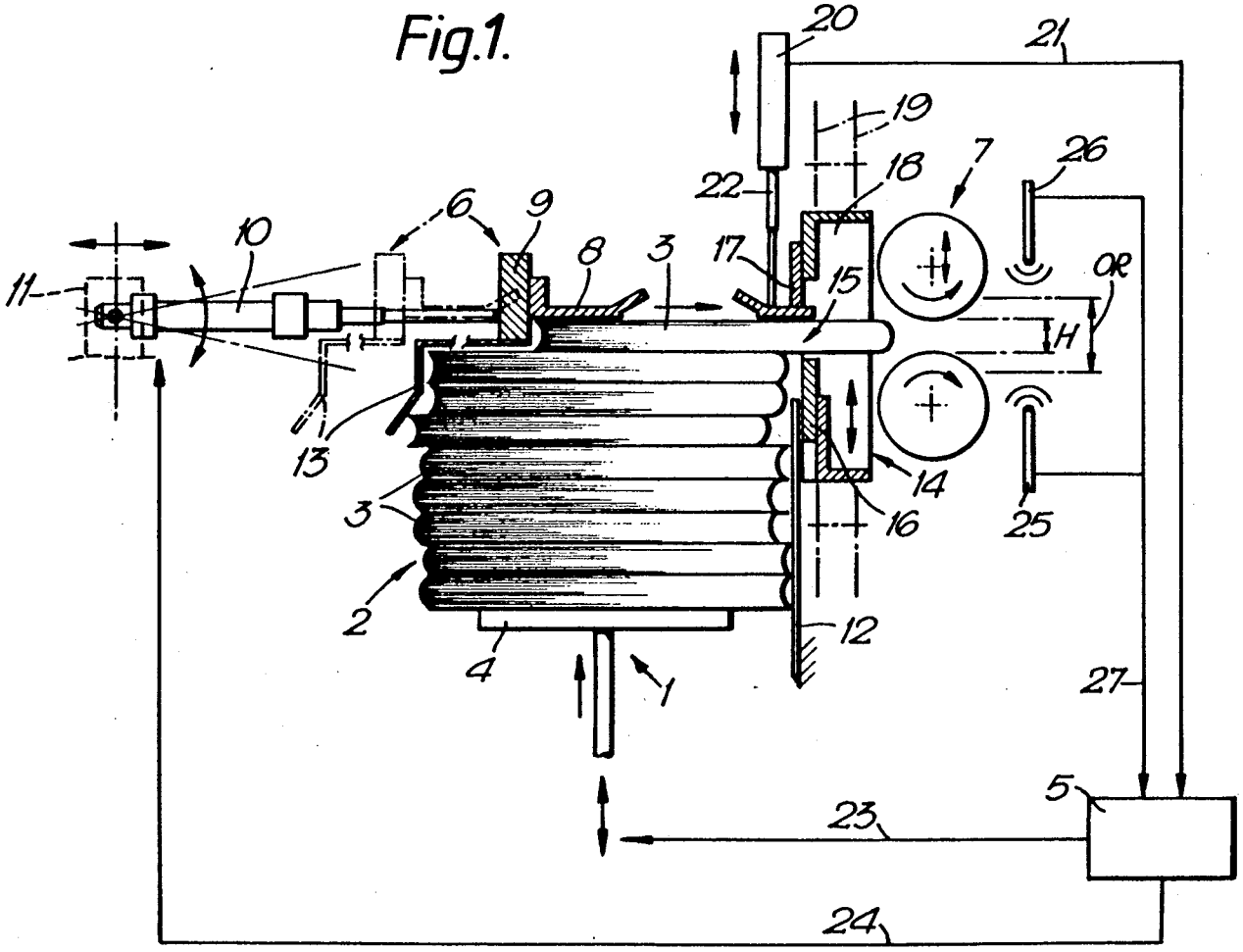

The invention relates to an apparatus for separating one or more essentially thin and planar products, such as books, periodicals and newspapers, from a stack of such products, comprising a stack-supporting means and a means for gripping at least one product at the top of the stack and for lateral movement of the product to engagement with a further-advancing transport means.

In distribution centres for periodicals, books, newspapers, advertising printed matters and similar publications, it is often desirable to co-pack centain numbers of the various products in one packet for joint packing, addressing and shipping. The ready-printed products usually are delivered to the distribution centre in standard bundles of e.g. 30, 40 or 50 copies, with for example 10 copies in each "laying", that is where the back side is turned in the same direction. In order to separate or pick a correct number of products, smaller than the number in the standard bundle, to an addressee, there is today used, with few exceptions, manual labour.

There is a great need for automation of the picking process, but such automation has been associated with substantial problems. The difficulties primarily are due to the fact that the products are so multifarious, heavy demands are made on measuring and adjustment, it is difficult to separate single products from a bundle, and the periodicals endure only small physical strain. In addition, heavy demands are made on speed, reliability and counting security.

The known solutions either have been based on pushing a given number of products collectively from a standard bundle, or picking one by one product (periodical) from the bottom of a bundle or pile. Common to the known methods has been limited applicability and very expensive solutions, so that these have not met the need. Normally, the solutions have required manual machine input and arranging of the products with the back side oriented in the same direction.

The object of the invention is to provide an apparatus of the introductorily stated type which is lenient in the handling of the products, which can separate or pick products from standard bundles with a laying (i.e. where the back side is facing in one or the other direction), which can handle a great spectrum of various paper products, and which operates reliably and with a high speed.

The above-mentioned object is achieved with an apparatus of the stated type wherein, according to the invention, the gripping means is vertically movable to automatically position itself in the correct functional position in relation to the top level of the stack, and wherein there is provided a threshold means forming an abutment against the products below said at least one product which is to be separated at a time, and which is provided with a slot opening having a height which is adapted to the product thickness in question, to allow the passing of only said at least one product at a time, said threshold means being vertically movable and being connected to a means providing for correct relative positioning of the threshold in relation to the top level of the stack.

The apparatus according to the invention has a number of important and advantageous properties which can be summarized as follows:

(1) Picking of products independently of the orientation of the back side, the opening side or the lateral side of the product.

(2) Picking from the top of a stack without necessarily loading the front side or back side of the product.

(3) Picking at a very high rate, since the top level of the stack does not need to be fixed.

(4) Physical security that only one product (or a cetain number of products) is separated at a time.

(5) High applicability for newspaper-like products which are very different with respect to paper quality, printing quality, frictional condition, format, bulk (uneven thickness of the surface), static adhesion and surface suction, trimming.

Figure 2:
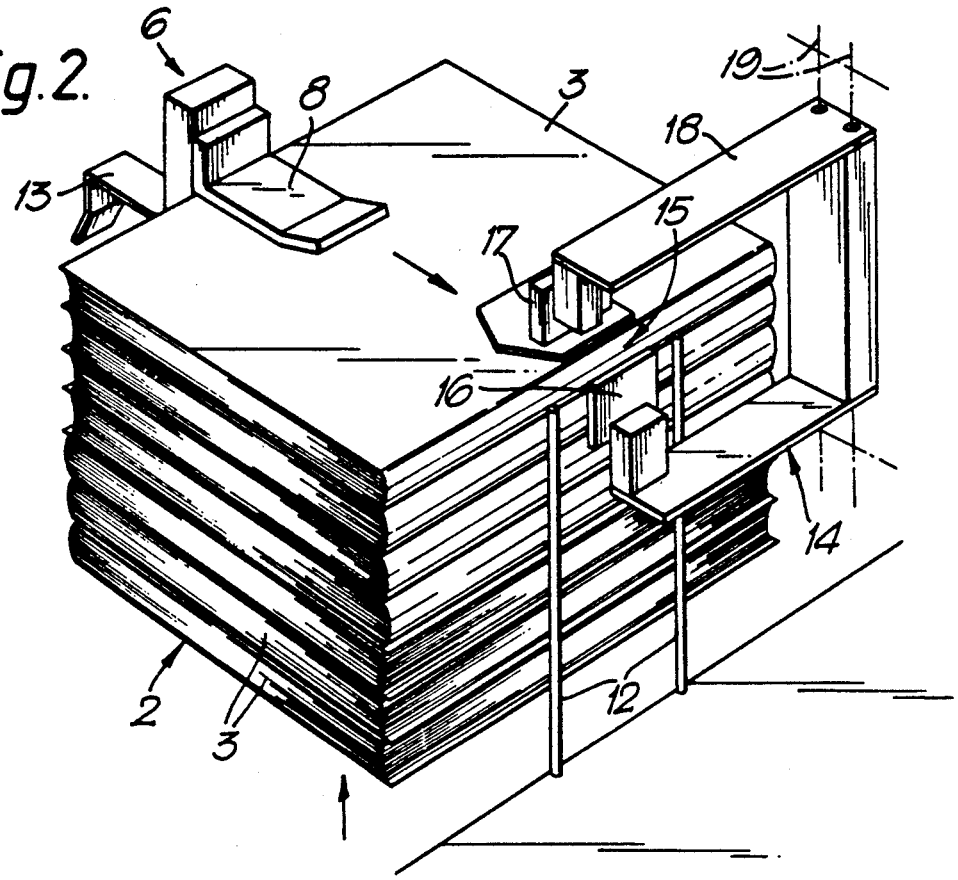
Figure 3:
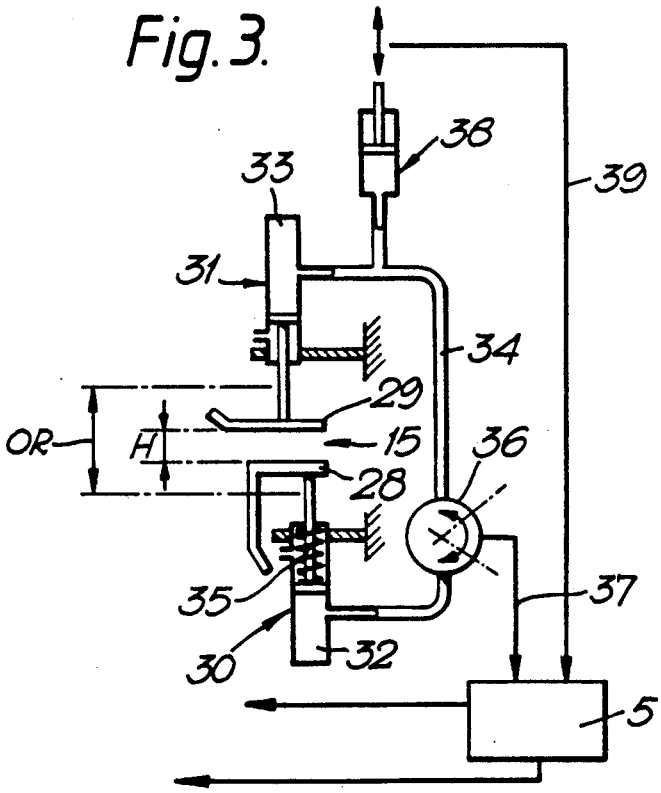

The invention will be further described below in connection with exemplary embodiments with reference to the accompanying drawings, wherein FIG. 1 shows a schematic, partly sectioned side view of an apparatus according to the invention;

FIG. 2 shows a schematic perspective view of parts of the apparatus in FIG. 1; and FIG. 3 shows an alternative embodiment of the threshold- and slot-forming means of the apparatus.

The apparatus shown in FIG. 1 includes an elevator or hoisting means 1 which is arranged for supporting and raising a stack 2 of a number of products 3 (such as books, periodicals or the like) as products are separated from the top of the stack. As shown the hoisting means comprises a stack-supporting hoist table 4 which, e.g., may consist of a number of rollers so that the stack in question can be advanced to the correct position by means of a belt feeder (not shown). Alternatively, the hoist table may be designed as a fork, so that a stack, which has been fed or carried forward by a suitable feeding device, is lifted thereby. The hoist table advantageously may be made somewhat slanting, so that the stack tends to lean against a fixed end wall. The hoist may, for example, be driven by a screwn which in turn may be driven by a motor having a speed control or clutch. This receives control signals from a regulator 5, so that the top of the stack 2 is maintained in the correct position, as further described below. When the hoist is empty of the products 3 in question, it is run down to a feeding-in position and is suppoied with another stack.

Further, the apparatus includes a gripping means 6 for gripping of at least one product 3 on the top of the stack 2 and for lateral movement of the product to engagement with a further-feeding forward-pulling or transport means 7. This means is shown in the form of a pair of mutually adjustable cooperating driven rollers, but it may alternatively consist of a driven belt, suction cups or the like.

The gripping means generally exerts a (substantially) horizontal force on the uppermost product to separate this from the rest of the stack. The gripping may be based on pushing against a transverse end of the product (as in the illustrated embodiment), friction against the upper side of the product, suction against the upper side of the product, or a combination of these principles.

In the illustrated embodiment the gripping means 6 consists of an abutment member 8 which is arranged to bear against the uppermost product in the stack, and a downwards projecting hook member 9 which in a suitable manner is adjustably fixed to the abutment member 8, so that it projects downwards therefrom a suitable distance to engage with the product, or the products, which is/are to be separated from the stack in each separating operation.

In the illustrated embodiment the gripping means 6 is attached to one end of a horizontally arranged, pneumatic working cylinder 10 which, at its other end, is rotatably fixed to a supporting means suggested with dashed lines at 11. Thus, the gripping means is free to move vertically within a limited region, so that it automatically positions itself in the correct functional position in relation to the top level of the stack 2, and thus can carry out its function when the top level fluctuates within a limited region. The working cylinder 10 has a stroke length corresponding to the desired lateral movement of the products which are separated, in order to carry these forward to engagement with the transport means 7. Further, the supporting means 11 is horizontally adjustable, for adaptation to the length of the products 3 in the stack.

It will be clear that the gripping means can be operated with other means than the illustrated working cylinder, for example a suitable motor having a corresponding movement freedom.

As shown, a so-called "jogger" 13 is associated with the gripper 6, with the purpose of aligning the products against a fixed end stopping means 12 at the front of the stack. It is thereby assured that the gripper achieves a correct engagement with the products as they are to be separated from the stack.

By means of the shown construction of the gripping means one achieves that the gripper will always grip and bring with it only one product, or exactly the desired number of products, and carry forward the product, or the products, with a controlled movement.

At the front side of the stack 2 there is provided a threshold means 14 forming an abutment against the products below the product or the products which is, respectively are, to be separated at a time. The threshold means is provided with a slot opening 15 of a height H which is adapted to the product thickness, in order to allow the passing of only the product or those products 3 which is, respectively are, to be separated from the stack 2 at a time.

In the illustrated embodiment the slot opening 15 of the threshold means is defined by a lower member or threshold member 16 and an upper member or top member 17 which, in a manner not further shown, is adjustably connected to a U-formed frame member 18. Thus, the height of the slot opening can be adjusted according to requirement. Said members 16, 17, 18 form a unit which is vertically movable, for example by means of linear guides as suggested at 19.

In connection with the threshold means 14 there is provided a position transmitter or position sensor 20 which is arranged to sense the top level of the stack 2 and to deliver a position signal to the regulator 5 on a line 21. The position sensor may be analog, e.g. comprise a linear potentiometer, or digital, e.g. consisting of a number of optical sensors sensing the position of the threshold. As shown, the sensor 20 is arranged to bear against the top of the stack in that it is physically connected to the top member 17 of the threshold means through a connecting rod 22. Dependent on the signal from the position sensor, the regulator 5 delivers control signals to the hoisting means 1 on a line 23, so that the hoisting means keeps the top level of the stack within a desired region. The regulator preferably seeks to maintain a hoist speed corresponding to the separation or picking rate. Analog speed control is preferred to on/off-control. When the correct level has been achieved, the regulator delivers a signal to the working cylinder 10 of the gripping means on a line 24, so that the working cylinder drives the gripping means 6 through a new separating operation. Separation takes place, with a frequency determined by the regulator, as long as the top level is maintained within the operational region, and until the desired number of products has been separated.

By means of the movable threshold means 14 and the interconnection with the position sensor 20 as described above, there is achieved that the threshold follows even if the hoisting means operates within an operational region OR which is substantially larger than the height H of the slot opening 15. The operational region of the apparatus, i.e. the vertical region wherein the gripper can be operated, thus is substantially larger than the thickness of the product or those products which is, respectively are, to be separed at a time. This increawsed operational region makes it possible to utilize a cheap, simple control of the vertical movement of the hoist. This is of substantial importance when it is the question of separation of thin products with a high speed, for example ca. 1 mm thick products with a speed of five products per second. It would then be associated with prodlems to operate a hoisting means without too high costs sufficiently accurately within one product thickness, i.e. with a requirement of $\pm 2$ mm for start, after-feeding and stop. With the shown, vertically movable gripper construction, the gripper can work within a larger level range, and the gripper and threshold cooperation ensures that only one product, or only the desired number of products, is separated at a time.

As shown in FIG. 1, the apparatus also includes a sensing means 25, 26 for sensing of the successive products separated from the stack. In the illustrated embodiment, the sensing means is of the optical type and is coupled to the regulator 5 through a line 27. The regulator is arranged to count and record the number of separated products, and to control the apparatus in dependence on the recorded number.

The threshold means in the apparatus according to the invention can be built in different manners without departing from the basic principle. For example, one may have a fixed threshold-defining end stop in combination with a position sensor bearding against a threshold top member at the top of the stack. The allowed operational region then will be equal to the height of the slot opening. Further, one may e.g. use hinges instead of the illustrated linear guides 19.

An alternative embodiment of the threshold means is shown in FIG. 3. The slot opening 15 of the threshold means here is defined by a lower and an upper member 28, 29 respectively which are connected to respective hydraulic cylinder/piston units 30, 31 of which the respective cylinders 32, 33, which are fixedly mounted, are in fluid connection with each other through a conduit 34. Thus, the height H of the slot opening is here maintained by hydrostatic balancing. A spring 35 is placed in the lower cylinder 32 to bias the threshold members 28, 29 in the upwards direction, so as to ensure that the upper threshold member 29 is brought to abutment against the upper side of the stack after each separating operation.

As an alternative to the linear potentiometer in the position sensor 20 in FIG. 1, a rotary or torsional cylinder 36 with a torsional potentiometer is connected in the conduit 34, for sensing of the top level of the stack. A position signal to the regulator 5 is delivered on a line 37. The height of the slot opening is adjustable by means of an additional cylinder/piston unit 38 which is connected to the conduit 34 between the cylinder/piston units 30, 31. A signal from the slot adjustment means 38 is supplied to the regulator 5 through a line 39.

As an alternative to the arrangement shown in FIG. 3, wherein the height of the slot opening is maintained by hydrostatic balancing, one could e.g. use a wire within a hose as the connection between the threshold members.

The apparatus described above includes a hoisting means maintaining the top level of the stack within a desired region. However, the apparatus may also be designed so that the stack with the products in question is stationary, whereas the gripper and the threshold means are moved downwards concurrently with the product separation, or it may be designed as a combination of these two principles. Normally, it will be suitable to separate and count only one product at a time, but the mode of operation will be the same when the gripper and the threshold device are adjusted so that two or more products are separated in each operation.

We claim:

1. An apparatus for separating one or more essentially thin and planar products from a stack of such products; comprising a stack-supporting means, a means for gripping at least one product at the top of the stack and for lateral movement of the product to engagement with a further-feeding transport means, said gripping means being vertically movable to automatically position itself in the correct functional position in relation to the top level of the stack, and a gate means having a threshold member forming an abutment against the products below said at least one product which is to be separated at a time, and having a slot opening having a height which is adaptable to the product thickness in question, to allow the passing of only said at least one product at a time, said gate means comprising a top member arranged to be kept bearing against the upper side of the stack, said top member and said threshold member being interconnected and vertically movable as a unit, said top member being connected to a means for sensing the top level of the stack and for delivering a signal to a regulator when said level is within a chosen operational region of said sensing means, said regualtor being arranged to ensure that the top level of the stack is within said operational region.

2. An apparatus according to claim 1, wherein said gripping means is attached to one end of an essentially horizontally arranged working cylinder which, at its other end, is pivotally attached to a supporting means, and which has a stroke length corresponding to the desired lateral movement of the products to be separated.

3. An apparatus according to claim 1 or 2, wherein said regulator is arranged to deliver a driving signal to said gripping means, to trip the lateral movement thereof after receipt of said signal from said sensing means.

4. An apparatus according to claim 1 or 2, wherein said means for sensing the top level of the stack is a position sensor which is physically connected to said gate means.

5. An apparatus according to claim 1 or 2, wherein said slot opening of said gate means is defined by members coupled to respective hydraulic cylinder/piston units of which the cylinders are in fluid connection with each other, for maintenance of said height of said slot opening by means of hydrostatic balancing.

6. An apparatus according to claim 5, wherein said height is adjustable by means of a cylinder/piston unit which is connected in a connecting conduit between said communicating cylinder/piston units.

7. An apparatus according to claim 1 or 2, wherein a sensor means is connected to said regulator for sensing and counting of the successive products which are separated from the stack.

* * * * *